US006294051B1

(12) United States Patent
Urquhart et al.

(10) Patent No.: US 6,294,051 B1
(45) Date of Patent: Sep. 25, 2001

(54) METHOD FOR IMPROVING THE EDGE STRENGTH OF A FIBROUS MAT

(75) Inventors: Richard Martin Urquhart, New Milford, CT (US); Paul Douglas Beuther, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/290,746

(22) Filed: Apr. 13, 1999

(51) Int. Cl.[7] ..... D21F 1/06

(52) U.S. Cl. ..... 162/212; 162/216; 162/123; 162/343

(58) Field of Search ..... 162/212, 216, 162/123, 258, 298, 336, 343

(56) References Cited

U.S. PATENT DOCUMENTS

| | | | | |
|---|---|---|---|---|
| 2,749,815 | | 6/1956 | Stewart | 92/44 |
| 2,904,461 | * | 9/1959 | Washburn et al. | 162/216 |
| 2,956,623 | | 10/1960 | Ikavalko | 162/338 |

(List continued on next page.)

FOREIGN PATENT DOCUMENTS

| | | | | |
|---|---|---|---|---|
| 36 41 598 A1 | | 7/1987 | (DE) . | |
| 37 15 551 A1 | | 12/1988 | (DE) . | |
| 37 15 554 A1 | | 12/1988 | (DE) . | |
| 445564 | * | 11/1991 | (EP) | 162/216 |
| 0 857 816 A1 | | 8/1998 | (EP) . | |
| WO 98/32916 A1 | | 7/1998 | (WO) . | |

OTHER PUBLICATIONS

Derwent World Patent Database abstract of FI 9001594 A: Description of Tampella OY AB (Tama), "Paper or Cardboard Production Machine." 1992.

Derwent World Patent Database abstract of FI 9105409 A: Description of Mononen K K (Mono–I), "Reinforcement Process for Edges of Paper and Cardboard Strips." 1991.

Derwent World Patent Database abstract of SU 482527 A: Description of UKR Pulp Paper Ind (UPUL–R), "Cardboard Forming Machine Bath." 1976.

Derwent World Patent Database abstract of SU 836265 B: Description of Cellulose Paper Ind Res (CEPA), "Newsprint Wood Cellulose Web Forming Head–Box." 1981.

Pratte, Bruce D., and W. Douglas Baines, "Profiles Of The Round Turbulent Jet In A Cross Flow," *Journal Of The Hydraulics Division*—Proceedings of the American Society of Civil Engineers, vol. 93, No. Hy 6, Nov. 1967, pp. 53–64.

*Primary Examiner*—Karen M. Hastings
(74) *Attorney, Agent, or Firm*—Thomas J. Connelly; Patricia A. Charlier

(57) ABSTRACT

An apparatus and method for forming a thin fibrous mat, such as a tissue sheet, with improved edge strength is disclosed. The apparatus includes a headbox having a top, a bottom, a pair of lateral sides, a back with an inlet formed therein and a front with an outlet formed therein. A first conduit is connected to the inlet of the headbox and flow therethrough is regulated to convey a first aqueous slurry at a desired flow rate into the headbox. The first aqueous slurry has a predetermined fiber consistency. A second conduit is connected to one of the lateral sides of the headbox and a second aqueous slurry is directed therethrough into the headbox at a different flow rate than through the first conduit. The apparatus also includes a mechanism for drying or draining water from the aqueous slurry exiting the outlet to form a thin fibrous mat. The thin fibrous mat has increased strength adjacent to an edge located downstream from the second conduit. The method includes the steps of introducing a first aqueous slurry to the inlet of the headbox and introducing a second aqueous slurry to at least one side of the headbox to form a fibrous mat with improved edge strength and better basis weight uniformity.

32 Claims, 7 Drawing Sheets

U.S. PATENT DOCUMENTS

| | | | | |
|---|---|---|---|---|
| 3,493,463 | * | 2/1970 | Baker | 162/310 |
| 4,166,001 | | 8/1979 | Dunning et al. | 162/111 |
| 4,387,003 | | 6/1983 | Meinecke et al. | 162/336 |
| 4,687,548 | | 8/1987 | Ilmoniemi et al. | 162/216 |
| 4,781,793 | | 11/1988 | Halme | 162/55 |
| 4,784,726 | | 11/1988 | Evalahti | 162/336 |
| 4,897,158 | | 1/1990 | Weisshuhn et al. | 162/259 |
| 4,927,499 | | 5/1990 | Wikman | 162/336 |
| 5,028,300 | | 7/1991 | Hollberg et al. | 162/115 |
| 5,149,402 | | 9/1992 | Riddick | 162/336 |
| 5,549,792 | * | 8/1996 | Begemann et al. | 162/336 |
| 5,573,642 | | 11/1996 | Begemann | 162/190 |
| 5,674,364 | | 10/1997 | Pitkajarvi | 162/216 |
| 5,833,808 | | 11/1998 | Shands et al. | 162/198 |
| 5,843,281 | | 12/1998 | Huovila | 162/216 |

* cited by examiner

METHOD FOR IMPROVING THE EDGE STRENGTH OF A FIBROUS MAT

FIELD OF THE INVENTION

This invention relates to an apparatus and method for improving the edge strength of a fibrous mat. More specifically, this invention relates to an apparatus and method for improving the edge strength and basis weight uniformity at the very edges of a fibrous mat during its formation.

BACKGROUND OF THE INVENTION

In producing a fibrous mat, such as a tissue sheet, on a fibrous mat making machine having a roll former, such as a Crescent former, it is common for one or both edges of the fibrous mat to be lower in basis weight than the center of the mat. This lower basis weight at one or both edges can lead to productivity delays due to tears. Since the edges are trimmed off later in the manufacturing process, the effect on the finished fibrous mat is minimal unless the low basis weight area is very wide. When the non-uniformity of the basis weight extends beyond the width of the material that is intended to be trimmed off of one or both edges, the quality of the manufactured product will be affected.

Therefore, there is a desire and need by manufacturers to improve the strength of the edges of a newly formed fibrous mat, as well as obtaining basis weight uniformity at the edges of the newly formed fibrous mat.

SUMMARY OF THE INVENTION

Briefly, this invention relates to an apparatus and method for forming a thin fibrous mat, such as a tissue sheet, with improved edge strength. The apparatus includes a headbox having a top, a bottom, a pair of lateral sides, a back with an inlet formed therein and a front with an outlet formed therein. The headbox is designed to receive a first aqueous slurry having a predetermined fiber consistency at the inlet. This first aqueous slurry is directed through the headbox to the outlet. A first conduit is connected to the inlet of the headbox and flow therethrough is regulated to convey the first aqueous slurry at a desired rate into the headbox. A second conduit is connected to one of the lateral sides of the headbox for directing a second aqueous slurry into the headbox. The flow rate of the second aqueous slurry is regulated to be at a much lower flow rate than the first aqueous slurry. The first and second aqueous slurries are blended to form a commingled aqueous slurry. The apparatus also includes a mechanism for draining water from the aqueous slurry exiting the outlet to form a thin fibrous mat. The thin fibrous mat has increased edge strength adjacent to an edge located downstream from the second conduit relative to a mat without a second conduit.

The method includes the steps of introducing the first and second aqueous slurries into the headbox, blending the slurries, passing the commingled slurry out of the headbox and then draining water from the aqueous slurry to form a fibrous mat.

The general object of this invention is to provide an apparatus and method for improving the edge strength of a fibrous mat. A more specific object of this invention is to provide an apparatus and method for improving the edge strength and basis weight uniformity at the very edges of a fibrous mat during its formation.

Another object of this invention is to provide an apparatus and method for improving the edge strength of a tissue sheet.

A further object of this invention is to provide an apparatus and method for producing a fibrous mat that is less likely to tear along an edge during manufacture.

Still another object of this invention is to provide an apparatus and method for improving the edge strength of a fibrous mat such that the fibrous mat has a uniform basis weight in the cross-direction at the edges of the mat.

Still further, an object of this invention is to provide an economical and efficient apparatus and method for improving the edge strength of a fibrous mat Other objects and advantages of the present invention will become more apparent to those skilled in the art in view of the following description and the accompanying drawings.

DETAILED DESCRIPTION OF THE PREFERRED EMBODIMENTS

Figure 1:
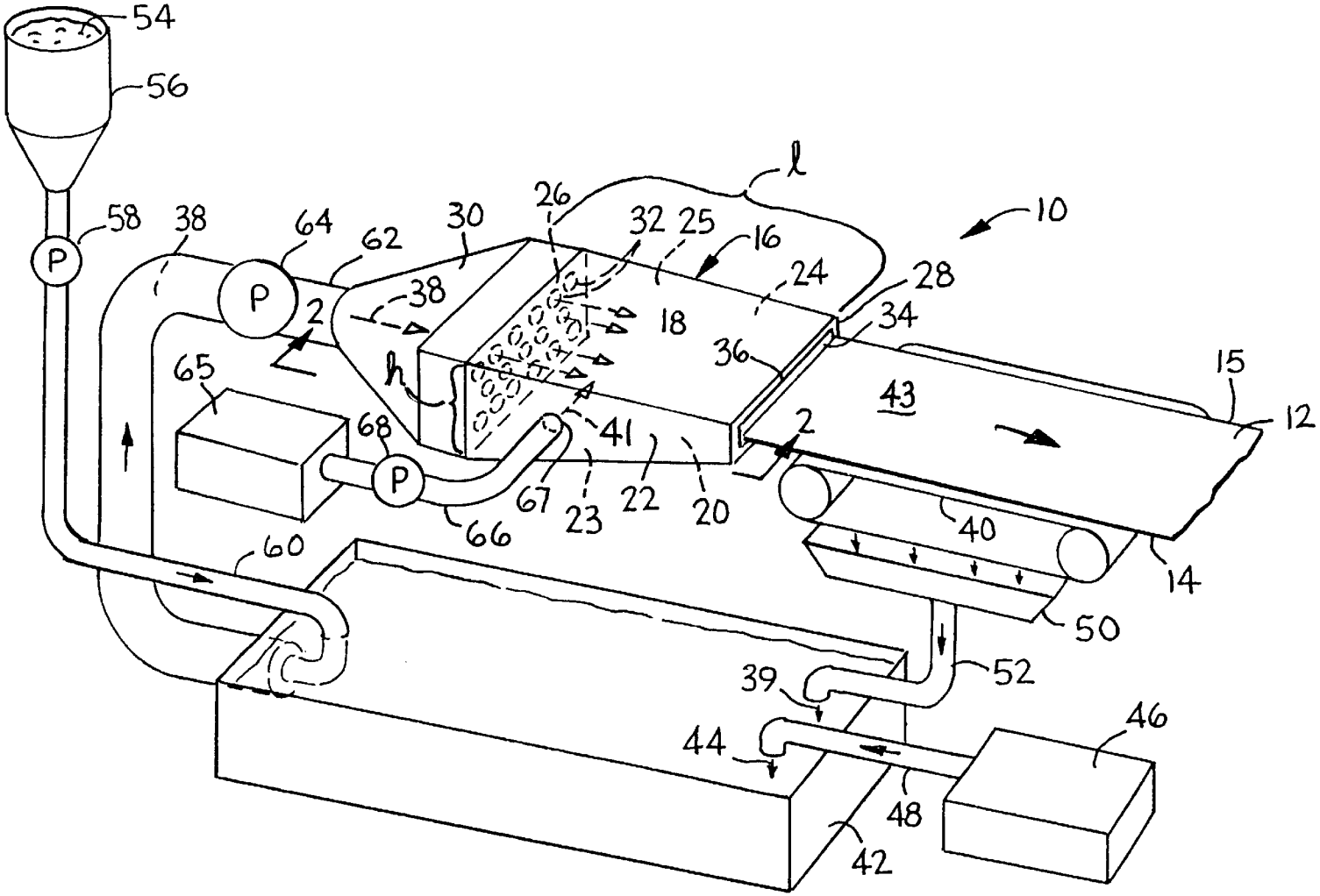
FIG. 1 is a schematic representation of this invention showing a number of conduits supplying an aqueous slurry to a headbox and having a forming fabric situated downstream of the headbox which supports the fibrous mat as water is being drained therefrom.

Referring to FIG. 1, an apparatus 10 is depicted for forming a thin fibrous mat 12 having improved strength along at least one side edge 14 or 15 thereof. The fibrous mat 12 can be formed of cellulose fibers into a tissue sheet, such as facial or bathroom tissue, a paper sheet, a paper towel, a wet wipe, or any other type of paper product. In addition, the fibrous mat 12 can be made from natural and/or synthetic fibers or a blend thereof. Such fibers can include polypropylene, polyethylene, rayon, cotton, glass, etc.

The apparatus 10 includes a headbox 16 having a top 18, a bottom 20, a pair of lateral sides 22 and 24, a back 26 and a front 28. Each of the lateral sides, 22 and 24 respectively, has an interior surface, 23 and 25 respectively. The headbox 16 has a length "l" and a height "h" with the height "h" decreasing along the length from the back 26 to the front 28. The back 26 has an inlet 30 formed therein which consist of a plurality of openings 32. The openings 32 can be arranged in horizontal rows that are laterally offset from one another. The front 28 has an outlet or slice 34 formed therein which consist of a single, narrow elongated opening 36 through which a first aqueous slurry 38 can exit. In a paper making operation, the first aqueous slurry 38 can contain water and fibers with the water representing over 99 percent, and commonly over 99.9 percent, of the basis weight. This first aqueous slurry 38 is supported by a continuously moving forming fabric 40 that can transport the first aqueous slurry 38 away from the headbox 16. Typically, the first aqueous slurry 38 is drained of a substantial amount of water while being transported by the forming fabric 40 to a drying zone (not shown). The drying zone can consist of one or more dryers, such as one or more Yankee dryers or one or more throughdryers which function to dry the fibrous mat into a dry product.

The apparatus 10 also includes a large holding tank, known as a tray chest 42. Fresh water 44 from a supply source 46 is directed via a pipe 48 into the tray chest 42. An aqueous fluid 39, consisting mostly of water but some fibers from the first aqueous slurry 38 which was drained from the forming fabric 40, is recovered in a collection basin 50. The aqueous slurry 39 in the collection basin 50 is directed via a pipe 52 to the tray chest 42. Lastly, a slurry 54 of concentrated fibrous material which is retained in a collection vessel 56 is directed by a pump 58 through a pipe 60 to the inlet of the first conduit 62. The concentrated fibrous slurry 54 is injected at the inlet of the first conduit 62, so that it does not completely mix with the recovered slurry 39 and the fresh water 44 that are in the tray chest 42. The first aqueous slurry 38 which is directed through the first conduit 62 is a combination of the various fluid streams 39, 44, and 54 which feed the tray chest 42. The fiber consistency of the first aqueous slurry 38 flowing through the first conduit 62 can be controlled to a predetermined value by the operator.

The apparatus 10 has a first conduit 62 with a pump 64 positioned there across for conveying and introducing the first aqueous slurry 38, at a desired flow rate, to the inlet 30 of the headbox 16. The first aqueous slurry 38 is pumped out of the tray chest 42 by the pump 64 such that the velocity, flow rate, pressure, etc. can be controlled and regulated to a desired value. This ensures that a continuous operation can be sustained over an extended period of time while producing a quality fibrous mat 12. The apparatus 10 also includes a second conduit 66 with a pump 68 positioned there across for conveying and introducing a second aqueous slurry 41, at a desired flow rate and fiber consistency, through the lateral side 22 of the headbox 16. The first and second aqueous slurries, 38 and 41 respectively, are blended to form a commingled aqueous slurry 43 which exits the headbox 16 via the outlet or slice 34. The second aqueous fluid 41 can be retained in a supply tank 65 and can be routed through the second conduit 66 to the headbox 16 by the pump 68. The second aqueous slurry 41 has a fiber consistency that is greater than, equal to or less than the fiber consistency of the first aqueous slurry.

The second conduit 66 has an orifice 67 that is formed approximately flush with the interior surface 23 of the lateral side 22. The orifice 67 is the discharge opening and has a diameter which should be sized to be much smaller than the height "h" of the headbox 16 at the location where the conduit 66 intersects the lateral sidewall 22. By "much smaller" is meant a value that is less than about 60%, and preferably less than about 50% of the height "h" of the headbox 16 at the point of discharge of the second aqueous fluid 41.

It is important to note that the orifice 67 should not cover a large percentage of the height "h" of the headbox 16 because it is desirable to inject the second aqueous slurry 41 a significant distance into the flow stream of the first aqueous slurry 38. By "significant" is meant a distance equal to at least about two times the diameter of the orifice 67. Preferably, at least about three times the diameter of the orifice 67. More preferably, at least about four times the diameter of the orifice 67, and most preferably, greater than about four times the diameter of the orifice 67. For example, the flow stream of the second aqueous slurry 41 could be injected such that it extends about two to four inches (about 50 to 100 mm) into the flow stream of the first aqueous slurry 38. Since some headboxes are wider than the forming fabric 40 used for drainage of the commingled aqueous slurry 43 or because the commingled aqueous slurry 43 is often trimmed to a narrower dimension before being dried, it is important that the second aqueous slurry 41 be injected a significant distance into the flow stream of the first aqueous slurry 38. If the orifice 67 is of such a diameter that it occupies a major portion of the height "h" of the sidewall 22, the second aqueous slurry 41 will not be able to penetrate the flow stream of the first aqueous slurry 38. Instead, the second aqueous slurry 41 will remain close to the interior surface 23 of the sidewall 22. In this scenario, the second aqueous slurry 41 will be limited to the very outer edge of the flow stream of the first aqueous slurry 38 and may be trimmed off before the fibrous mat 12 is dried. Alternatively, if the headbox 16 is wider than the forming fabric 40, the second aqueous slurry 41 may never even get to form the fibrous mat 12.

In the past, manufacturers have tried to inject a second slurry at a very slow velocity in the cross-machine-direction but this limited the influence of the second slurry to a region of the headbox that was unlikely to contribute to edge strength. Still other manufacturers have added complex equipment inside the headbox to direct the second slurry to approximately the central region of the first flow stream. Such equipment is difficult to add to an existing headbox as well as being expensive. This equipment also limits the ability of one to adjust the cross-directional location at which one desires to add basis weight to the fibrous mat 12.

It is preferred that the shape of the orifice 67 be round or circular, although other shapes can be employed. It is very easy to add an orifice 67 to a lateral side 22 or 24 of an existing headbox. It is preferred that the orifice 67 be vertically centered on the lateral side 22 or 24 of the headbox 16. If the headbox has two or more channels formed therein, then the orifice 67 should be vertically centered relative to the respective channel with which it intersects. The reason for vertically centering the orifice 67 on the lateral side 22 or 24, or on one of the channels in a layered headbox, is to minimize the size of any vortex that might form from the injected flow of the second aqueous slurry 41. In addition, a vertically centered position for the orifice 67 will generate less vorticity than an offset position.

Returning again to the second conduit 66, it should be noted that the second aqueous slurry 41 can be pumped through the second conduit 66 by the pump 68 such that the velocity, flow rate, pressure, etc. can be controlled and regulated to a desired value. The flow of the second aqueous slurry 41 through the second conduit 66 is substantially less than the flow of the first aqueous slurry 38 through the first conduit 62. By "substantially less" is meant a value that is less than about 1% of the flow rate through the first conduit 62. The exact flow rate depends on the size and configuration of the headbox 16 along with other factors.

As shown in FIG. 1, the first aqueous slurry 38 and the second aqueous slurry 41 are obtained from separate vats or tanks 42 and 65 but could be obtained from a single source if desired. The first and second aqueous slurries, 38 and 41 respectively, could have identical or different fiber consistencies.

Figure 2:
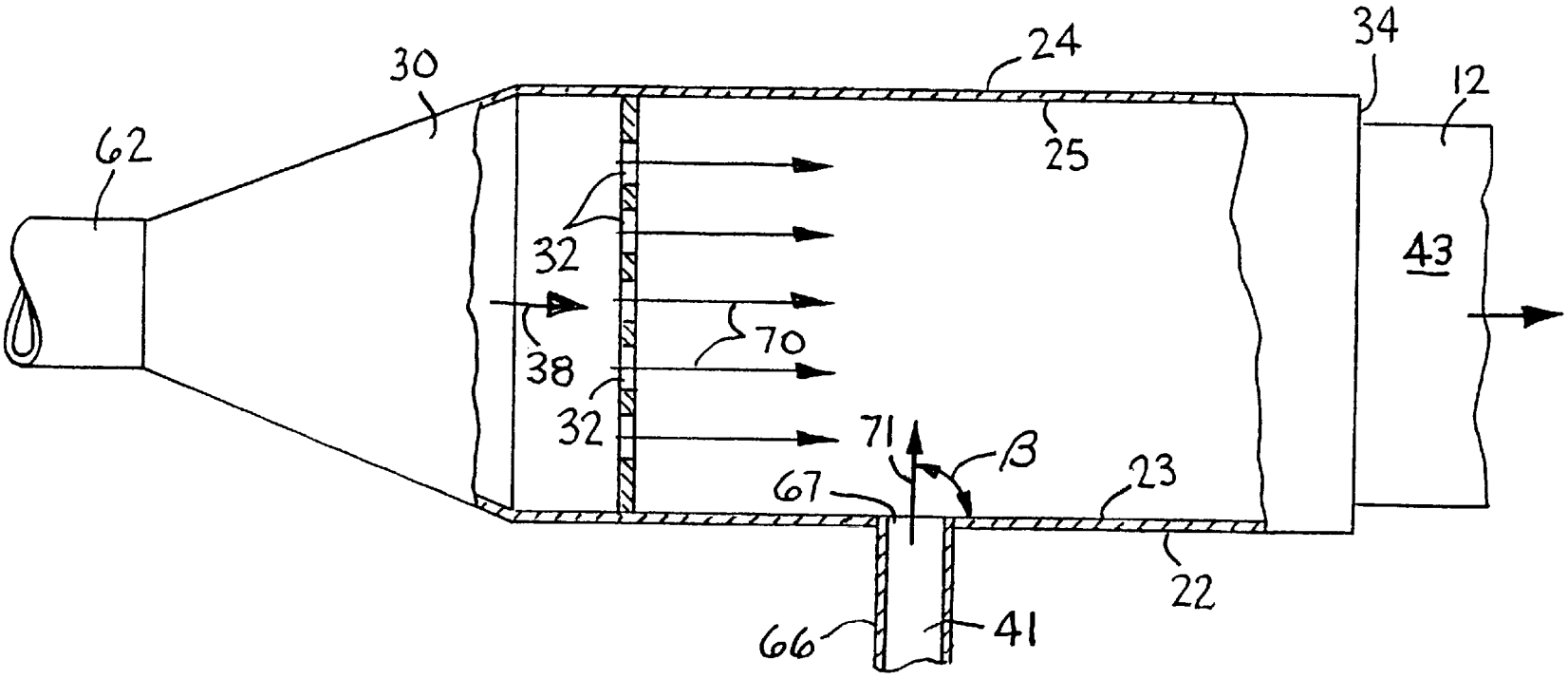
FIG. 2 is a sectional view of a headbox shown in FIG. 1 taken along line 2—2 showing the orientation of a conduit introducing an aqueous slurry into a lateral side of the headbox so as to form a fibrous mat having improved edge strength.

Referring to FIG. 2, the headbox 16 is shown with the first aqueous slurry 38 entering through the inlet 30 and flowing left to right toward the outlet or slice 34. This first flow direction represents a first flow stream 70 of the first aqueous slurry 38 and can also be referred to as the main flow stream. The second conduit 66 introduces a second flow stream 71 of the second aqueous slurry 41 at an angle to the first flow stream 70. The second flow stream 71 is injected at an angle beta (β) of from between about 45° to about 135° to the direction of flow of the first flow stream 70. Preferably, the second flow stream 71 is injected at an angle beta (β) of from between about 75° to about 135° to the direction of flow of the first flow stream 70. More preferably, the second flow stream 71 is injected at an angle beta (β) of from between about 75° to about 105° to the direction of flow of the first flow stream 70. Most preferably, the second flow stream 71 is injected at approximately a right angle (approximately 90°) to the direction of flow of the first flow stream 70.

It should be noted that the second flow stream can be injected at an angle of from between about 95 degrees to about 135 degrees such that it flows backward against the first flow stream 70. For some processes this may be preferred.

It should also be noted that the second aqueous slurry 41 should be injected horizontally into the first flow stream 70 in order to minimize generation of large vortices. By "horizontally" it is meant parallel to the headbox 16 in the cross-machine-direction.

The velocity, flow rate, pressure, volume and consistency of the second aqueous slurry 41, which exits the second conduit 66, will impact the extent to which the second aqueous slurry 41 will intercept and extend into the first flow stream 70. The purpose of introducing the second aqueous slurry 41 into at least one of the lateral sides 22 or 24 of the headbox 16 is to correct for any deficiency of the first aqueous slurry 38 caused by frictional forces and/or flow patterns within or outside the headbox 16. The second aqueous slurry 41 introduced or injected through the second conduit 66 will also increase the basis weight of the fibrous mat 12 along at least one of the side edges, 14 and 15 respectively. This increase in basis weight will assist in preventing tears from forming in one or both of the side edges 14 and/or 15 as the fibrous mat 12 is being formed and/or dried.

It should be noted that it is important to know approximately the number and size of the orifices 67 that should be formed in the lateral sides 22 and/or 24 of the headbox 16 without conducting expensive trials. An estimate of the desired number, size and flow through the orifice(s) 67 into the headbox 16 can be made by referring to literature discussing the behavior of a jet in a cross flow. One such publication is entitled: "Profiles of the Round Turbulent Jet in a Cross Flow" by B. D. Pratte and W. D. Baines, Proceedings of ASCE, Journal of the Hydraulics Division, published November 1967, pp. 56–63. To estimate a desired injection system, two things must be considered. First, the amount of added basis weight must be determined and the extent of that addition in the cross direction. The latter is determined by accurately measuring the current basis weight profile in narrow strips. A typical deficiency might be 10% over a distance of about 3 inches (about 150 mm). It is important to measure this profile because if too much of the second aqueous slurry 41 is added, the basis weight will be heavy on the edge, and this can cause problems with drying (wet streaks) and incomplete cutting with a trim or tail cutter. The distance the second aqueous slurry 41 is designed to travel in the cross direction should be selected such that it extends over the outer half of the measured basis weight deficit profile. Any additional distance due to wet end trimming or width differences between the headbox 16 and the forming fabric 40 can be added in. The distance the second aqueous slurry 41 travels in the cross-machine direction can be approximated from the above reference if one corrects for the taper in a typical headbox by stretching the downstream coordinate with the actual residence time in the headbox.

Using such a technique, an approximate relationship can be established and is expressed as equation 1. Equation 1 works when one assumes that the injection point of the second aqueous slurry 41 is well upstream of the outlet 34. This is a distance equal to many diameters of the orifice 67. In addition, one must assume that the diameter of the orifice 67 is significantly smaller than the height of the headbox 16 or height of a channel in a layered headbox.

$$h^3 = \frac{4.3\mathrm{TAN}(\alpha)D^2V_j^2x^2}{(V_0Q)} \qquad \text{Equation 1}$$

where

- h is the cross direction distance the second aqueous slurry 41 travels (meters);
- α is the half-angle of the convergence of the top and bottom of the headbox;
- D is the diameter of the orifice 67 (meters);
- $V_j$ is the cross-machine-direction velocity of the second aqueous slurry 41 at the interior surface of the lateral side 22 (meters/second);
- x is the distance between the orifice 67 and the outlet or slice 34 (meters) and is arbitrarily selected depending on the type of equipment available;
- $V_0$ is the machine-direction velocity of the first flow stream 70 at the orifice 67 (meters/second); and
- Q is the volumetric flow per unit width of the headbox 16 (meters$^3$/second/meter).

Equation 1 can provide several solutions for a given headbox that determine various unique diameter and injection velocity combinations. If one also considers the amount of the second aqueous slurry 41, which is to be added, into the calculation, a second equation can be developed:

$$nV_jC_j\pi D^2/4 = SQC_b^h \qquad \text{Equation 2}$$

- n is the number of orifices 67 per lateral side of the headbox 16;
- S is a variable which represents the amount of basis weight one desires to add to the edge of the fibrous mat, expressed as a fraction of the bone dry basis weight of the fibrous mat.

For example, 0.05 for a 5% increase.

$C_j$ is the concentration of fibers in the second aqueous slurry 41;

$C_b$ is the average concentration of fibers in the headbox 16; and $\pi$ is the ratio of the area of a circle to the square of its radius, approximately 3.14.

The other variables are identical to those defined for the first equation. These two equations can be solved for the diameter and velocity of the injected aqueous flow to provide an estimate for how to design and implement an edge stock injection system as shown in equation 3 and 4.

$$D = \sqrt{\frac{QShC_b}{n(\pi/4)V_jC_j}} \quad \text{Equation 3}$$

$$V_j = \frac{n(\pi/4)h^2V_0C_j}{4.3\text{TAN}(\alpha)x^2SC_b} \quad \text{Equation 4}$$

Referring again to FIG. 1, it should be noted that during manufacture, it is common for tears to extend into the transverse or cross-direction of the fibrous mat 12. Downstream from the drying equipment, the fibrous mat 12 is normally trimmed along one, and preferably both, of the lateral side edges, 14 and 15 respectively. However, if the tears extend far enough into the fibrous mat 12, they will still be present after the fibrous mat 12 is trimmed and this will cause the finished product to be rejected as unacceptable for its intended use. The presence of tears in the fibrous mat 12 during manufacture also presents the problem that a tear may rip completely across the mat 12 and cause a delay in production while the ruined material is removed.

By increasing the basis weight of the fibrous mat 12 along one or both of the lateral side edges, 14 and 15 respectively, a more uniform basis weight of the commingled aqueous slurry 43 can exit the headbox 16. As water is drained from the commingled aqueous slurry 43 while it is being transported on the forming fabric 40, a better quality fibrous mat 12 can be formed. Without the presence of tears, less scrap is produced and the efficiency of the operation increases. This reduces cost and provides faster throughputs because the machine production does not have to be stopped and restarted at frequent intervals.

Figure 3:
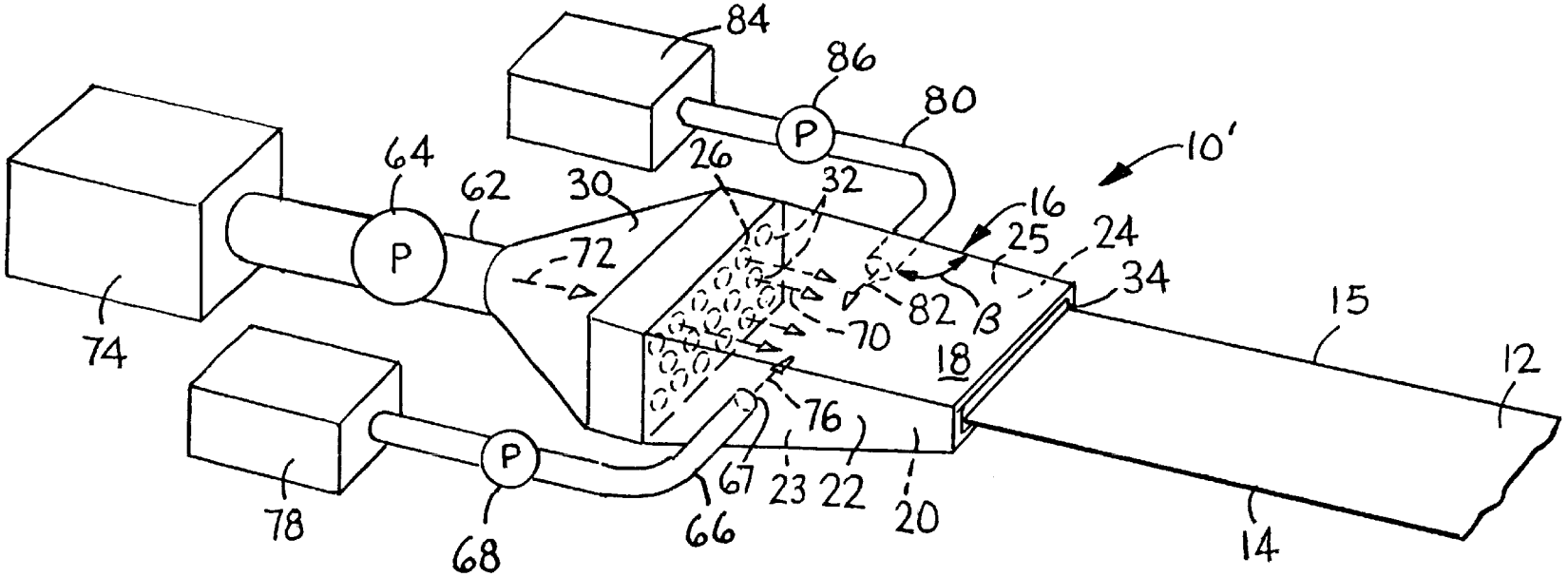
FIG. 3 is a schematic representation showing a main conduit directing an aqueous slurry to the inlet of the headbox and two additional conduits which introduce an aqueous slurry into the lateral sides of the headbox.

Referring now to FIG. 3, an alternative embodiment of an apparatus 10 is depicted forforming a thin fibrous mat 12. This apparatus 10 differs from the apparatus 10 shown in FIG. 1 in that it has second and third conduits connected to the headbox. In FIG. 1, a first aqueous slurry 72 is directed via the conduit 62 to the inlet 30 of the headbox 16 from a first supply tank 74. The first supply tank 74 supplies the inlet 30 of the headbox 16. The first aqueous slurry 72 is pumped from the first supply tank 74 through the conduit 62 by the pump 64. This first aqueous slurry 72 will represent the greatest volume of aqueous slurry entering the headbox 16 and will constitute the first or main flow stream 70. The apparatus 10 also includes a second conduit 66 which directs a second aqueous slurry 76 from a second supply tank 78 through the lateral side 22 of the headbox 16. The second aqueous slurry 76 is routed through the conduit 66 by the pump 68. The volume of the second aqueous slurry 76 is substantially less than the volume of the first aqueous slurry 72 that is introduced into the headbox 16. By "substantialy less" is meant that the volume of the second aqueous slurry 76 is less than about 1% of the volume of the first aqueous slurry 72.

The second aqueous slurry 76 can also have a different concentration of fibers than the first aqueous slurry 72. Preferably, the concentration of fibers in the first aqueous slurry 72 is lower than the concentration of fibers in the second aqueous slurry 76. It is also possible to vary the fiber species within each of the first and second aqueous slurries, 72 and 76 respectively. For example, the second aqueous slurry 76 can contain only softwood fibers while the first aqueous slurry 72 contains both softwood and hardwood fibers.

It should also be noted that the second aqueous slurry 76 could contain a chemical that could be added to enhance the strength, color, texture, etc. of the edge 14. Almost any type of chemical could be added. Examples include kymene or starch.

The apparatus 10 further includes a third conduit 80 that is connected to the opposite lateral side 24 of the headbox 16. The third conduit 80 directs a third aqueous slurry 82 from a third supply tank 84 to the headbox 16. The third aqueous slurry 82 is pumped through the third conduit 80 by a pump 86. The flow of the third aqueous slurry 82 preferably is introduced into the headbox 16 at a right angle or perpendicularly to the direction of flow of the first flow stream 70. This means that the third conduit 80 should be perpendicularly aligned at approximately a 90° angle to the lateral side 24 of the headbox 16. However, the third conduit 80 can be connected to the lateral side 24 at an acute or obtuse angle such that the third aqueous slurry 82 is introduced into the first flow stream 70 at an angle beta (β) of from between about 45° to about 135°. Preferably, the angle beta (β) is from between about 75° to about 135° and, more preferably, the angle beta (β) is from between about 75° to about 105°.

The third aqueous slurry 82 can be introduced or injected into the headbox 16 through the third conduit 80 at a flow rate which is less than, identical to, or greater than the flow rate through the second conduit 66. Preferably, the flow rate of the second and third aqueous slurries, 76 and 82 respectively, through the second and third conduits, 66 and 80 respectively, will be approximately at the same flow rates. The volume of the third aqueous slurry 82 flowing into the headbox 16 from the third conduit 80 will be substantially less than the volume of the first aqueous slurry 72 flowing into the headbox 16 from the first conduit 62. By "substantially less" is meant that the volume of the third aqueous slurry 82 is less than about 1% of the volume of the first aqueous slurry 72. The exact volume depends on the size and configuration of the headbox 16 along with other factors.

The third aqueous slurry 82 can have a different concentration of fibers than the first aqueous slurry 72. Preferably, the concentration of fibers in the first aqueous slurry 72 is lower than the concentration of fibers in the second or third aqueous slurries, 76 or 82 respectively. It is also possible to vary the fiber species within each of the first, second and third aqueous slurries, 72, 76 and 82 respectively. For example, the second and third aqueous slurries 76 and 82 can contain only softwood fibers while the first aqueous slurry 72 contains both softwood and hardwood fibers. Typically, the second and third aqueous slurries, 76 and 82 respectively, will be the same but they could vary if desired.

One reason why it is beneficial to increase the fiber concentration in the second and third aqueous slurries, 76 and 82 respectively, is to ensure that adequate fibers are present along the lateral side edges 14 and 15 of fibrous mat 12. This will facilitate formation of the fibrous mat 12 with improved edge strength and reduce the tendency of the developments of tears forming perpendicularly or at an angle to the side edges 14 and 15.

Figure 4:
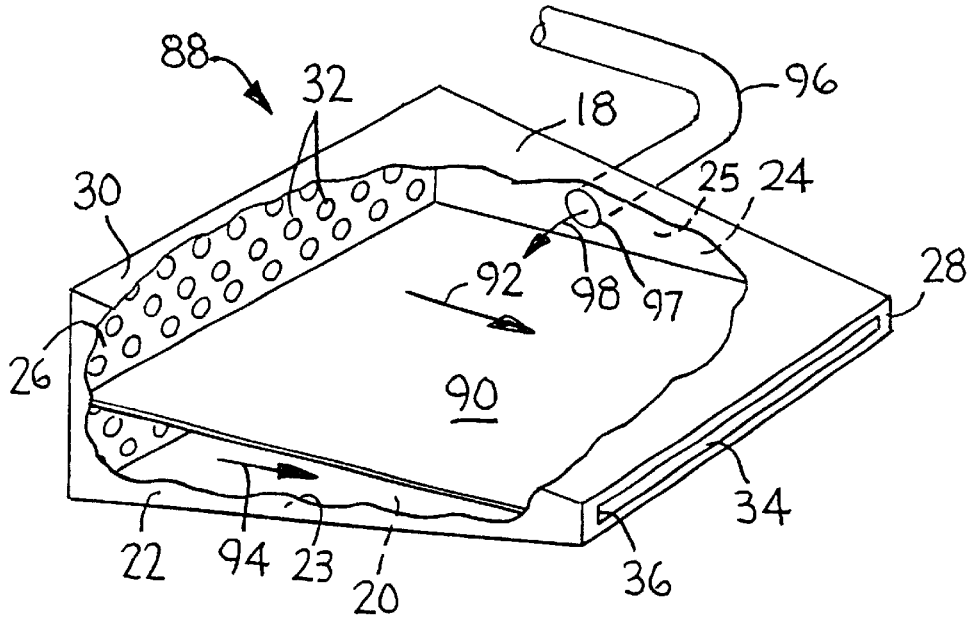
FIG. 4 is a perspective view of a two layered headbox having a partition which vertically divides the headbox into an upper portion and a lower portion and showing a conduit introducing an aqueous slurry into the upper portion through a lateral side of the headbox.

Referring to FIG. 4, a headbox 88 having two layers is shown which is similar in external appearance to a single layered headbox 16. For ease in understanding, similar numbers will be used to describe the headbox 88 with two layers as were used to describe the single layered headbox 16. The headbox 88 with two layers has a top 18, a bottom 20, a pair of lateral sides 22 and 24, a back 26 and a front 28. The back 26 has an inlet 30 formed therein which consist of a plurality of openings 32. The openings 32 can be arranged in horizontal rows that are laterally offset from one another. The front 28 has an outlet or slice 34 formed therein which consist of a single, narrow elongated opening 36 through which a thin, aqueous slurry can exit. The headbox 88 with two layers also contains a partition 90 formed therein which is positioned between the top 18 and the bottom 20. The partition 90 functions to separate flow of aqueous slurry through the headbox 88. The partition 90 is arranged within the headbox 88 to divide and separate the incoming aqueous slurry into first and second distinct flow streams, 92 and 94 respectively.

The aqueous slurry entering at the openings 32, above and below the partition 90, can be of the same consistency and fiber mix or they can be different. One of the benefits of using a headbox 88 with two layers is that the fiber mix and/or fiber consistency of the first flow stream 92 can be different from the second flow stream 94. When making tissue in particular, it is common to place hardwood fibers in one flow stream and softwood fibers in a second flow stream so that the finished product will have hardwood fibers on an outer surface. The shorter hardwood fibers tend to convey a softer feel than the longer softwood fibers that are primarily used to increase the strength of the tissue sheet. The partition 90 will keep the first and second flow streams, 92 and 94 respectively, separate and distinct until they approach the outlet or slice 34. At the outlet or slice 34, the two flow streams 92 and 94 will merge and exit as a unitary fibrous slurry 43 (see FIG. 5) which can be dried into a fibrous mat 12.

The headbox 88 with two layers also has a conduit 96 which connects to the lateral side 24 of the headbox 88 and introduces an aqueous slurry 98 at an angle, preferably about 90 degrees, to the first flow stream 92. In this embodiment, the conduit 96 is positioned above the partition 90 but it should be understood that the conduit 96 could discharge the aqueous slurry 98 into the second flow stream 94 if it was constructed lower in the lateral side 24. The conduit 96 terminates at an orifice 97 that is formed in the lateral side 24 of the headbox 88. The orifice 97 is formed flush with the inside surface 25 of the lateral side 24. The size of the orifice 97 is typically much smaller than the height of the headbox 88 or the height of one of the flow streams 92 and 94, also referred to as channels, at the point of injection of the aqueous slurry 98. By "much smaller" is meant a value that is less than about 60%, and preferably, less than about 50%, of the height of the headbox 88 or the height of one of the channels in the headbox 88 separated by the partition 90. Preferably, the shape of the orifice 97 is round or circular, although other shapes are possible. It is also preferred that the orifice 97 be vertically centered in the lateral side 24 of the headbox 88 or in one of the channels separated by the partition 90 and which it intersects. The flow rate of the aqueous slurry 98 introduced or injected into the headbox 88 is at a lower rate than the flow entering through the inlet 30. Also, the fiber consistency, volume, species of fibers, as well as the addition of desired chemicals, dyes, additives, etc. can be controlled such that the aqueous slurry 98 is either the same or different from the aqueous slurry 92 entering through the inlet 30.

Figure 5:
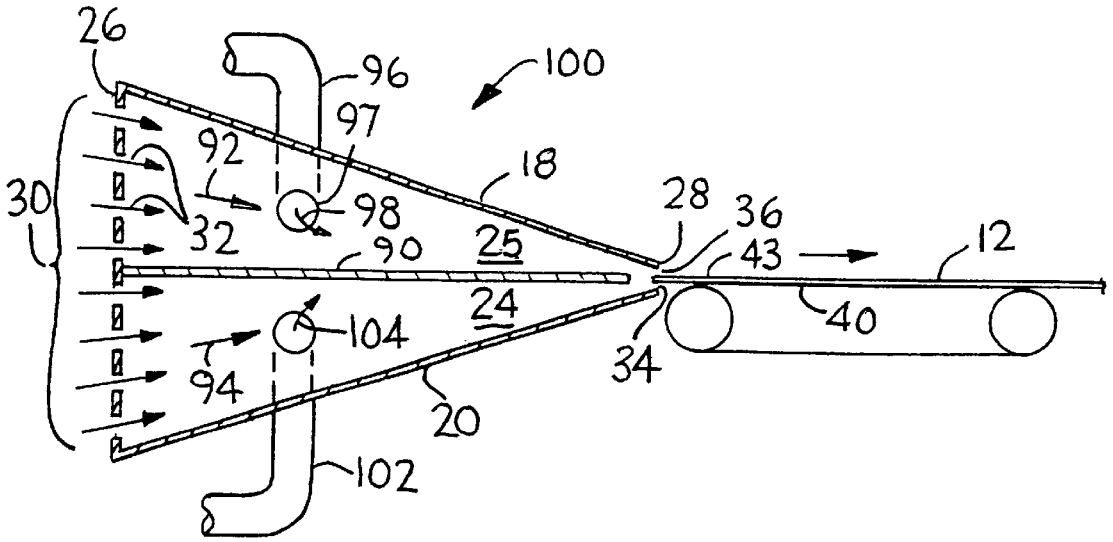
FIG. 5 is a cross-sectional view of an alternative embodiment of this invention showing a two layered headbox having two conduits which introduce an aqueous slurry into both the upper portion and the lower portion through a lateral side of the headbox.

Referring to FIG. 5, another embodiment of a headbox 100 having two layers is shown. In this embodiment, in addition to the conduit 96, a second conduit 102 is located in the lateral side 24 of the headbox 100 to introduce an aqueous slurry 104 below the partition 90. Even though both conduits 96 and 102 are depicted as being connected to the lateral side 24, they could be formed in the lateral side 22, if desired. Furthermore, one of the conduits 96 or 102 could be formed in the lateral side 22 and the other conduit 96 or 102 could be formed in the lateral side 24. By constructing the conduits 96 and 102 such that one connects to each of the lateral sides, 22 and 24 respectively, the edge strength of the two opposite lateral side edges 14 and 15 of the fibrous mat 12 can be improved. The conduits 96 and 102 terminate flush with the interior surface 25 of the lateral side 24 with an orifice, 97 and 99 respectively. The size of each of the orifices 97 and 99 is typically much smaller than the height of the headbox 100 or the height of a channel formed in the headbox 100 by the partition 90 at the location where the aqueous slurries 98 and 104 are introduced. By "much smaller" is meant a value that is less than about 50% of the height of the headbox 100 or the height of a channel formed in the headbox 100 by the partition 90. It is desirable that the shape of the orifices 97 and 99 be round, although other shapes are possible. It is also desirable to vertically center each of the orifices 97 and 99 in the headbox 100 or in a channel formed in the headbox 100 by the partition 90 at a location where the aqueous slurries 98 and 104 are introduced.

Figure 6:
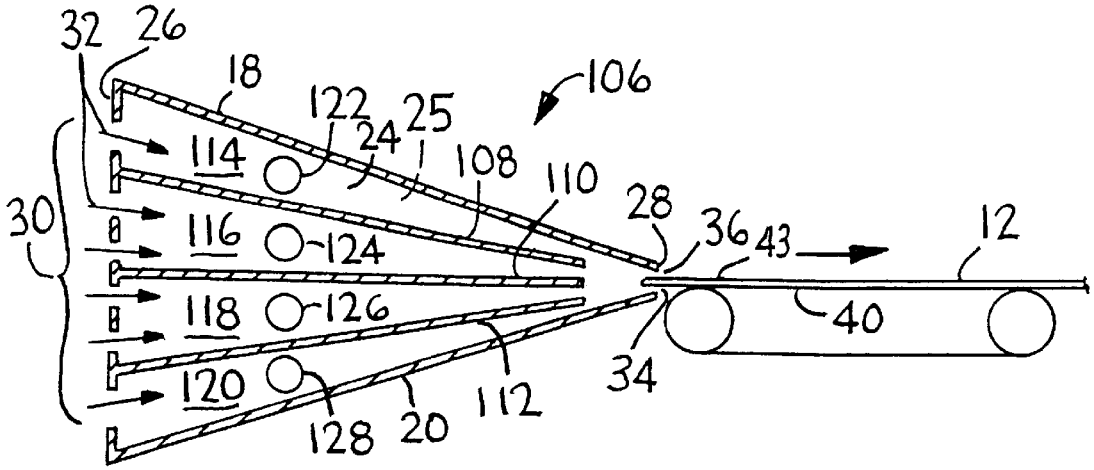
FIG. 6 is a cross-sectional view of still another embodiment of this invention showing a four layered headbox having four conduits which introduce an aqueous slurry into each chamber through a lateral side of the headbox.

Referring now to FIG. 6, a multilayered headbox 106 is shown having three partitions 108, 110 and 112 formed between the top 18 and bottom 20. Although this embodiment shows three partitions 108, 110 and 112, it should be recognized that any number of partitions could be employed. Typically, a multilayered headbox will have two or more partitions. Additional partitions can be present if the physical dimensions permit them. The presence of at least two partitions distinguishes a multilayered headbox from a single layer headbox 16 or a headbox 88 having two layers.

In the headbox 106, each of the three partitions 108, 110 and 112 functions in a similar manner to that described above for the partition 90. The three partitions 108, 110 ◡d 112 will divide the headbox 106 into four separate and distinct flow streams 114, 116, 118 and 120. Each of the flow streams 114, 116, 118 and 120 is associated with a port 122, 124, 126 and 128 formed flush with the lateral side 22 of the headbox 106. The ports 122, 124, 126 and 128 are connected to conduits (not shown) which direct and convey an aqueous slurry to the multilayered headbox 106.

The multilayered headbox 106 can be designed such that each of the flow streams 114, 116, 118 and 120 has an orifice associated therewith or only certain of the flow streams 114, 116, 118 and 120 have an orifice associated therewith. The orifice should be formed flush with the interior surface 25 of the lateral side 24. The introduction or injection of an aqueous slurry via the orifices 122, 124, 126 and 128 allows for improved edge strength of the fibrous mat 12. The orifice 122, 124, 126 and 128 also provide a means for changing the fiber consistency, volume, species of fibers, as well as the addition of desired chemicals, dyes, additives, etc. to one or more of the flow streams 114, 116, 118 and 120.

Figure 7:
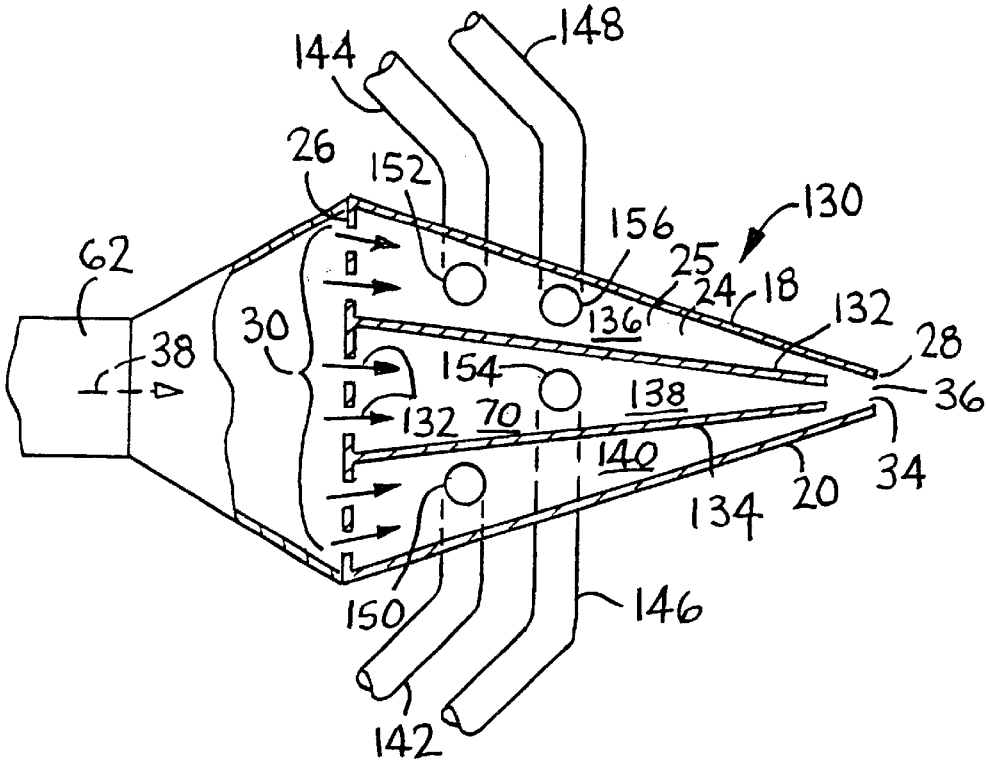
FIG. 7 is a cross-sectional view of yet another embodiment of this invention depicting four conduits introducing an aqueous slurry into a lateral side of the headbox with the two lower conduits being horizontally aligned from one another and the two upper conduits being offset from one another in the horizontal plane.

Referring to FIG. 7, a multilayered headbox 130 is shown having two spaced apart partitions 132 and 134 situated between the top 18 and the bottom 20. The partitions 132 and 134 separate the multilayered headbox 130 into three flow streams 136, 138 and 140. The multilayered headbox 130 also has a first conduit 62 that directs and conveys a first aqueous slurry 38 into the inlet 30 and through the plurality of openings 32. Although only one supply conduit 62 is shown, multiple conduits could be used, each supplying the same or a different aqueous slurry to one or more of the flow streams 136, 138, or 140. The first aqueous slurry 38 forms the first or main flow stream 70 within the multilayered headbox 130 and travels horizontally from left to right toward the outlet or slice 34. The multilayered headbox 130 also has a second, a third, a fourth and a fifth conduit, 142, 144, 146 and 148 respectively, which connect with the lateral side 24 of the headbox 130. The second conduit 142 terminates at an orifice 150 which is aligned with the third flow stream 140. The orifice 150 is located below the second partition 134. The third conduit 144 terminates at an orifice 152 which is aligned with the first flow stream 136. The orifice 152 is located above the first partition 132. The fourth conduit 146 terminates at an orifice 154 which is aligned with the second flow stream 138. The orifice 154 is located below the first partition 132 and above the second partition 134. Lastly, the fifth conduit 148 terminates at an orifice 156 which is aligned with the first flow stream 136. The orifice 156 is located above the first partition 132 and downstream of the port 154.

The above arrangement of the orifices 150, 152, 154 and 156 with the various flow streams 136, 138 and 140 allow various aqueous slurries to be introduced into the multilayered headbox 130 in various fashions. For example, the second and fourth conduits, 142 and 146 respectively, are arranged to convey the aqueous slurries above and below at least one of the partitions 132 or 134. The third and fifth conduits, 144 and 148 respectively, are arranged to convey aqueous slurries to one side of at least one of the partition 132 or 134. Preferably, the orifices 150, 152, 154 and 156 are vertically centered relative to the height of the headbox 130 or relative to one or more channels formed in the headbox 130 by the partitions 132 and 134.

It should be noted that when two or more orifices 150, 152, 154 and 156 are constructed to introduce aqueous slurries into a single flow stream, that the orifices 150, 152, 154 and 156 can be horizontally aligned with one another or be offset from one another. The orifices 150, 152, 154 and 156 could also be coaxially aligned to one another if desired. Preferably, when two or more orifices are constructed to introduce aqueous slurries into a single flow stream the orifices can be arranged symmetrically to the height of the channel 136, 138 and 140 formed by the partitions 132 and 134 to avoid adverse vorticity. Even though two or more orifices 152 and 156, see FIG. 7, can be formed in a single layer or channel of the headbox 130, it is preferred that only one orifice 150, 152, 154 or 156 be formed in each layer or channel of the headbox 130. It should be noted that equations 1–4, taught above, are based upon one orifice per channel.

METHOD

Figure 8:
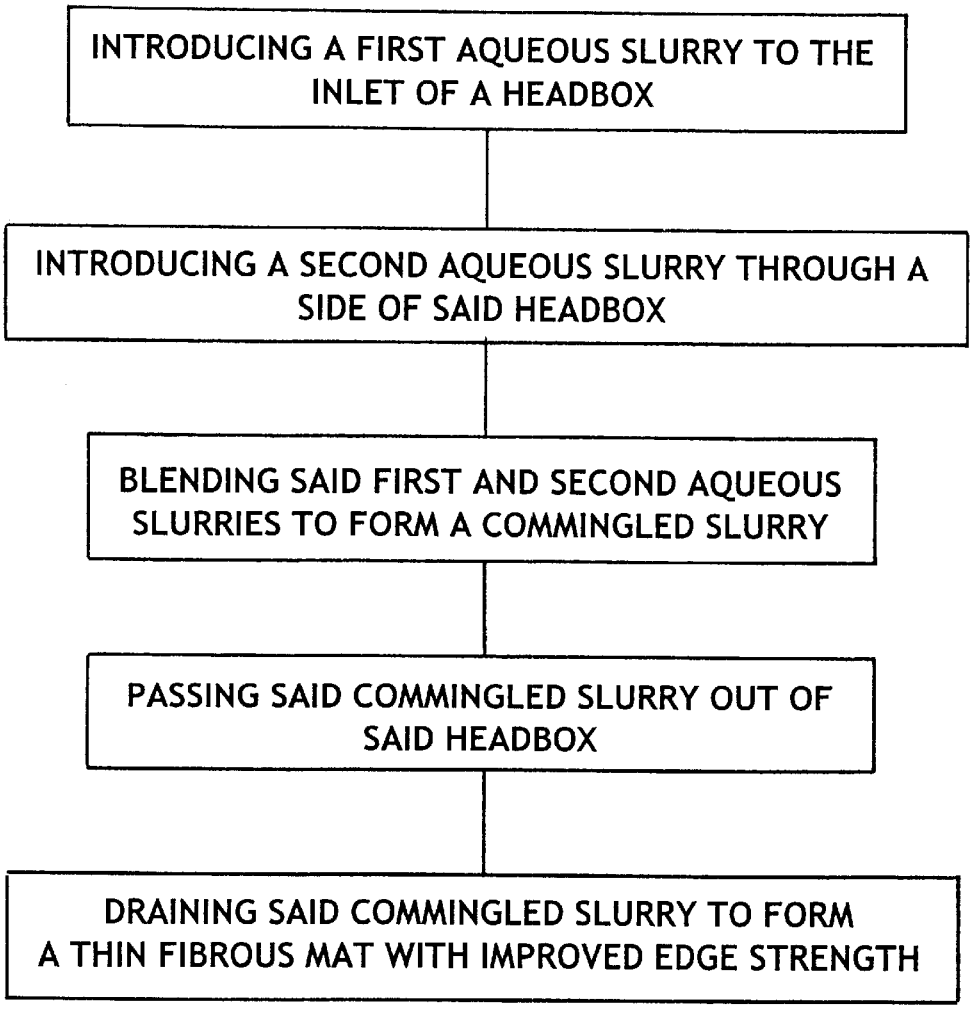
FIG. 8 is a flow diagram of a method for improving the edge strength of a fibrous mat.
Figure 9:
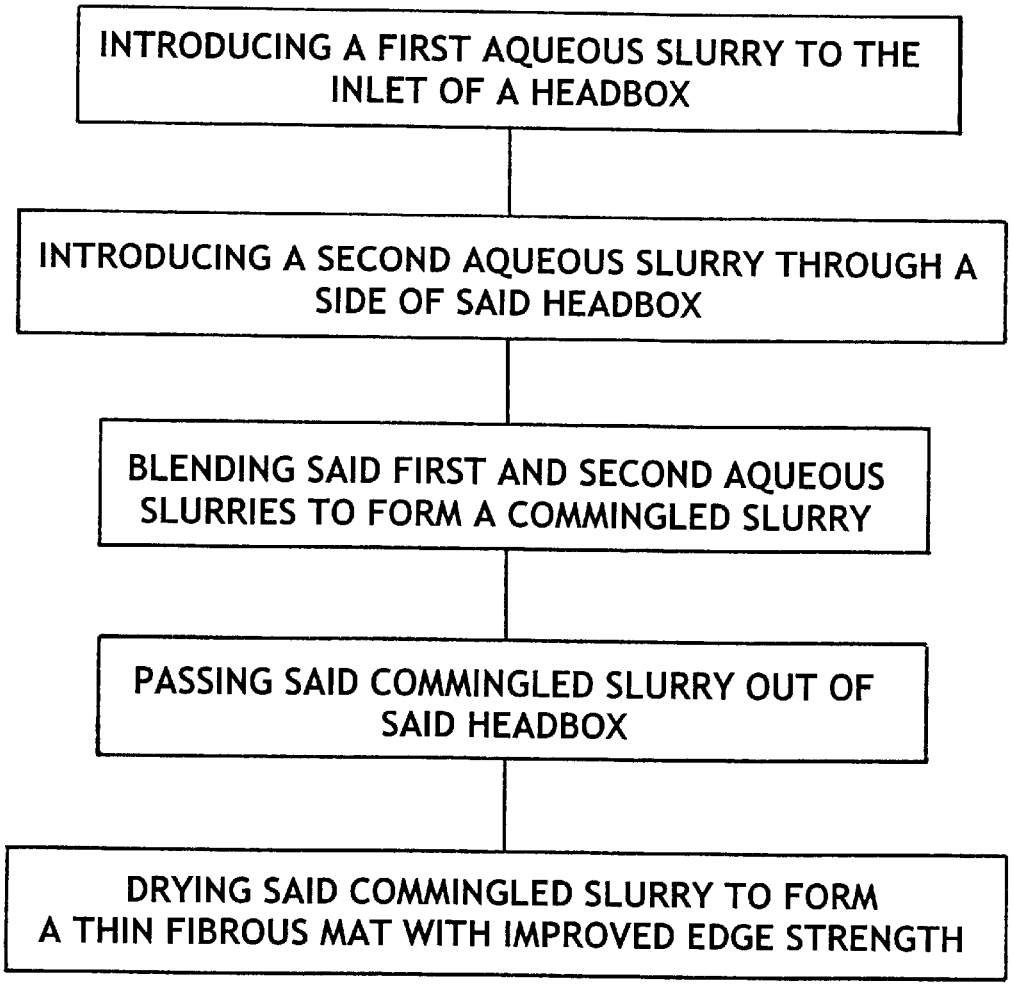
FIG. 9 is a flow diagram of an alternative method for improving the edge strength of a fibrous mat.

The method of improving the edge strength of a fibrous mat 12, especially a thin fibrous mat such as a tissue sheet, is best understood with reference to FIGS. 8 and 9. The method includes the following steps directing and introducing or injection of a first aqueous slurry 38, having a predetermined fiber consistency and a first flow rate, to the inlet 30 of a headbox 16. The volume, pressure, flow rate, fiber consistency, etc. can be adjusted to best fit one's manufacturing equipment. The first aqueous slurry 38 is conveyed through the headbox 16 to the outlet or slice 34 and forms the first or main flow stream 70 passing through the headbox 16. A second aqueous slurry 41 having a predetermined fiber consistency and a second flow rate is introduced into the headbox 16 through one of its lateral sides 22 or 24. The second aqueous slurry 41 intercepts the first flow stream 70 at an angle beta (β) of from between about 45 degrees to about 135 degrees. Preferably, the angle beta (β) is approximately 90°.

The second aqueous slurry 76 is blended with the first aqueous slurry 38 at a predetermined volume and velocity to form a commingled aqueous slurry 43 which exits the headbox 16 through the outlet or slice 34. It should be noted that the first and second aqueous slurries, 38 and 41 respectively, can be identical or different. When the second aqueous slurry 41 contains a higher concentration of fibers than the first aqueous slurry 38, one can be assured that the edges 14 and 15 of the fibrous mat 12 will have improved edge strength. However, even with equal or lower consistencies, the second aqueous slurry 41 imparts a momentum in the cross-machine direction away from the edge, 14 or 15, that can aid in reducing the amount of fibers flowing off the edge of the forming fabric 40. This cross-machine directed momentum may also affect the direction of the mean orientation of the fibers near the edge 14 or 15 as others patents have shown. However, for tissue sheets, this is not an important consideration. By "mean orientation" is meant the average direction of the major axis of the tensile curves. Normally, this is aligned with the machine-direction but flows in the cross-machine direction can cause this to align at a small angle to the machine-direction, especially at the edge of the headbox 16.

A number of patents are concerned with modifying this orientation but it has little or no concern for many fibrous mat products, such as tissue paper. A more significant fiber orientation modification for productivity and for products, such as tissue paper, that is unique to the present invention is the potential to change the ratio between machine-direction and cross-direction tensile strength near the edges 14 and 15 of the fibrous mat 12. The effect that the aqueous slurry 38 can have on the momentum of the headbox flow in the machine-direction near the edges 14 and 15, by partially blocking the flow through the channel of the headbox 16, can change the relative orientation between the machine-direction and the cross-direction tensile strength. While this depends on the specific process conditions, for typical tissue manufacturing conditions, a reduction in machine-direction momentum will result in a higher machine-direction fiber orientation for the fibers on the edges 14 and 15 of the fibrous mat 12 where the adjacent added second aqueous slurry 41 has an effect. This re-orientation of the fibers at the edges 14 and 15 can be beneficial to edge strength.

As the commingled aqueous slurry 43 exits the headbox 16 it is supported and transported away by the continuous forming fabric 40. The aqueous slurry 43 will have either an equal number of fibers or an excess of fibers located downstream from the point of discharge of the second aqueous slurry 41. The edge 14, located downstream of the introduction of the second aqueous slurry 41, will have an added momentum directed away from the edge 14 of the fibrous mat 12, as well as a different, preferably higher, ratio of machine-direction strength to cross-direction strength. This cross-machine-direction momentum can counterbalance the natural drainage momentum that is directed toward the edge 14. This will produce a fibrous mat 12 having a more uniform basis weight in the transverse or cross direction near the edge 14. The fibrous mat 12 will also have improved edge strength along the edge 14.

While on the forming fabric 40, excess liquid, mostly water, is drained from the commingled aqueous slurry 43 so that its percent of liquid decreases. The water can be drained from the fibrous mat 12 using known equipment such as an air press, one or more suction devices, vacuum devices, pressurized air, etc.

The finished fibrous mat 12 can be a tissue sheet useful in making facial or bathroom tissue, or it can be paper, wet wipes, or some other type of sheet product. The product can be made from natural or synthetic fibers or be a blend thereof. Natural fibers include cellulosic fibers obtained from plants or trees, such as hardwood and softwood pulp fibers. Another natural fiber that can be used is cotton. The synthetic fibers can be produced from chemicals such as polypropylene, polyethylene, rayon, glass, or blends thereof. Many other types of natural and synthetic fibers are known to those skilled in the paper making and fabric making arts.

The method can include introducing a third aqueous slurry 82, having a predetermined fiber consistency and a third flow rate, to a lateral side 24 of the headbox 16. Preferably, the second aqueous slurry 41 or 76 is introduced to one lateral side 22 of the headbox 16 and the third aqueous slurry 82 is introduced to the opposite lateral side 24 of the headbox 16. The second aqueous slurries 41 or 76, and third aqueous slurry 82, can have the same fiber consistency as well as the same flow rate, if desired. It should also be noted that the first aqueous slurry 38 will usually be introduced into the headbox 16 at a higher flow rate and at a lower concentration of fiber than the second aqueous slurries 41 or 76, or third aqueous slurry 82.

Referring now to FIG. 9, the method taught above is altered slightly by drying the commingled slurry 43 instead of draining the commingled slurry 43 once it exits the headbox 16. The wet fibrous mat 12 can be dried using one or more dryers, such as one or more Yankee dryers, one or more throughdryers, or some other type of drying equipment to form a dry fibrous mat. The drying can be accomplished by exposing the commingled aqueous slurry 43 to an elevated temperature, that is a temperature above room temperature. Preferably, the elevated temperature is from between about 100° F. to about 1,000° F. (about 55° C. to about 55° C.) above room temperature. Most preferably, the elevated temperature is at least about 150° F. (at least 83° C.) above room temperature.

Using either of the above methods, once the fibrous mat 12 has been formed and dried, one and preferably both edges 14 and 15 are trimmed to produce a finished sheet having a predetermined width. In the preferred embodiment, the trimming operation will cut off a small quantity of material, from about 0.25 inches to about 6 inches (about 6.4 mm to about 152 mm), from each of the edges 14 and 15. Preferably, about 2 inches (about 51 mm) of material are trimmed from each of the edge 14 and 15. The trimming will assure that if any small tears develop along one of the two edges 14 and 15, that they will be removed from the finished product.

EXAMPLES

The following three examples are meant to show how the four equations taught above can be used to approximate the results with some reasonably engineering accuracy. Further optimization can be accomplished by altering the consistency and flow rate of the aqueous slurry that is injected into the headbox. The purpose of providing these examples is to show how dependent the process conditions are to the injection method. The injection velocities often need to be very large in order to overcome the momentum of the headbox flow.

Example 1

For this example, a headbox having three separate layers or channels was used. The headbox had a width of about 20 inches (about 0.5 meters). The headbox had a total convergence of 7.5 degrees, which equated to a half angle of 3.75 degrees. The headbox had an outlet or slice of about 0.75 inches (about 19 mm). The velocity of the commingled aqueous slurry 43 was about 3,000 feet/minute (about 15 meters/second) and the orifice was located about 12 inches (about 30 cm) upstream of the outlet or slice. It was desired to correct a 5% basis weight deficit over a distance of about 2 inches (about 50 mm) with one round orifice on one edge of the fibrous mat. The consistencies of the first and second aqueous slurries was approximately equal and in the range of about 0.1% fiber. The headbox was wider than the width of the wet trim by about 1 inch (about 25 mm) on the one edge adjacent to the location of injection of the second aqueous slurry. This made the targeted distance at which the second aqueous slurry was to be injected into the first flow stream about 3 inches (about 75 mm) from the respective lateral side of the headbox. Thus the distance the second aqueous slurry was to be introduced into the first flow stream was a distance greater than about eight times the diameter of the orifice. Using equations 3 and 4, recited above, to solve for the diameter of the orifice resulted in a diameter of about 0.36 inches (about 9.1 mm). The injection velocity was calculated to be about 3,400 feet/minute (about 17 meters/second). This is equivalent to a volumetric flow rate of about 17.5 gallons/minute (about 1100 milliliters/second). For this particular headbox, the calculated flow was about 1%. Of the total commingled aqueous slurry flow, the actual basis weight increase was measured to be about 4% at the respective edge of the fibrous web, with a diminishing effect further into the web. The impact of the second aqueous slurry decayed to zero at a distance of about 4 inches (about 100 mm) in from the respective edge.

Example 2

For this example, a headbox having nine multiple layers or channels was used. The headbox had a total convergence of 15 degrees, an outlet or slice of about 0.5 inches (about 13 mm). The velocity of the commingled aqueous slurry was about 5,000 feet/minute (about 25 meters/second) and the orifice was located about 30 inches (about 75 cm) upstream of the outlet or slice. It was desired to correct a 5% basis weight deficit over a distance of about 3 inches (about 75 mm) with one round orifice on one edge of the fibrous mat. The consistencies of the first and second aqueous slurries was approximately equal and in the range of about 0.1% fiber. The headbox was wider than the width of the wet trim by about 1 inches (about 25 mm) on each edge. This made the targeted distance that the second aqueous slurry should be injected into the first flow stream about 4 inches (about 100 mm) from the respective lateral side of the headbox. Using equations 3 and 4, recited above, to solve for the diameter of the orifice resulted in a diameter of about 2 inches (about 50 mm). The equations also indicated that an injection velocity of about 150 feet/minute (about 0.7 meters/second) should be used with a volumetric flow rate of about 26 gallons/minute (about 1600 ml/second). However, since each layer or channel of the headbox had a height dimension that was less than this value, an orifice of this size could not be used.

In order to make it work, three smaller round orifices could be substituted for the one large orifice and each of the three smaller orifices would be located in a separate layer or channel of the headbox. The resulting target diameter for each of the three smaller orifices was about 0.69 inches (about 17.5 mm). The injection velocity was calculated to be about 440 feet/minute (about 2.2 meters/second). This is equivalent to a flow rate of about 8.7 gallons/minute (about 550 ml/second). This equated to a total flow through the three small orifices of about 26 gallons/minute or about 1600 ml/second.

Example 3

For this example, a headbox identical to that described in Example 2 was used. However, one difference was that the consistency ratio between the second aqueous slurry and first aqueous slurry was changed to about 3 to 1. With just one injection orifice in each lateral side of the headbox, the equations indicated a targeted diameter of about 0.69 inches (about 17.5 mm). The equations also indicated that the injection velocity of the second aqueous slurry should be about 440 feet/minute (about 2.2 meters/second) and the total flow rate of about 8.7 gallons/minute (550 ml/second).

While the invention has been described in conjunction with several specific embodiments, it is to be understood that many alternatives, modifications and variations will be apparent to those skilled in the art in light of the aforegoing description. Accordingly, this invention is intended to embrace all such altematives, modifications and variations which fall within the spirit and scope of the appended claims.

We claim:

1. A method for improving the edge strength of a thin fibrous mat comprising the steps of:

a) introducing a first aqueous slurry having a predetermined fiber consistency to an inlet of a headbox and conveying said first aqueous slurry through said headbox to an outlet, said headbox having a top, a bottom, a pair of lateral sides, a back with an inlet formed therein and a front with an outlet formed therein, said lateral sides having an interior surface, said headbox having a length and a height with said height decreasing along said length from said back to said front, and said first aqueous slurry forming a first flow stream through said headbox in a first flow direction;

b) introducing a second aqueous slurry having a predetermined fiber consistency through a round orifice formed in at least one of said pair of lateral sides, said orifice having a diameter which is less than about 60% of said height of said headbox and said orifice being flush with said interior surface of one of said pair of lateral sides, said orifice being formed at a first position along said length of said headbox, and said second aqueous slurry being introduced into said first aqueous slurry as a second flow stream at a second flow direction, said second flow direction being at an angle of from between about 45 degrees to about 135 degrees to said first flow direction;

c) blending said second aqueous slurry into said first aqueous slurry at a predetermined volume and velocity to form a commingled aqueous slurry with said second aqueous slurry being introduced into said headbox with said velocity sufficient to allow said second aqueous slurry to penetrate into said first low stream a distance equal to at least about twice the diameter of said orifice;

d) passing said commingled aqueous slurry out of said headbox; and e) draining water from said commingled aqueous slurry to form a fibrous mat, said fibrous mat having increased strength adjacent to an edge located downstream from a point where said second aqueous slurry was introduced.

2. The method of claim 1 further including introducing a third aqueous slurry having a third flow rate into said other lateral side of said headbox.

3. The method of claim 2 further including introducing said second aqueous slurry at a different fiber consistency than said third aqueous slurry.

4. The method of claim 2 further including introducing said second aqueous slurry at a different flow rate than said third aqueous slurry.

5. The method of claim 1 wherein said second aqueous slurry is introduced into said side of said headbox at an angle of about 90 degrees to said direction of flow of said first aqueous slurry.

6. The method of claim 1 wherein said orifice has a diameter which is less than about 50% of said height of said headbox at said first position.

7. The method of claim 1 wherein said first aqueous slurry is introduced into said headbox at a higher fiber consistency than said second aqueous slurry.

8. A method for improving the edge strength of a thin fibrous mat comprising the steps of:

a) introducing a first aqueous slurry having a predetermined fiber consistency to an inlet of a headbox and conveying said first aqueous slurry through said headbox to an outlet, said headbox having a top, a bottom, a pair of lateral sides, a back with an inlet formed therein and a front with an outlet formed therein, said lateral sides having an interior surface, said headbox having a length and a height with said height decreasing along said length from said back to said front, and said first aqueous slurry forming a first flow stream through said headbox in a first flow direction;

b) introducing a second aqueous slurry having a predetermined fiber consistency through a round orifice formed in at least one of said pair of lateral sides, said orifice having a diameter which is less than about 60% of said height of said headbox and said orifice being flush with said interior surface of one of said pair of lateral sides, said orifice being formed at a first position along said length of said headbox, and said second aqueous slurry being introduced into said first aqueous slurry as a second flow stream at a second flow direction, said second flow direction being at an angle of from between about 45 degrees to about 135 degrees to said first flow direction;

c) blending said second aqueous slurry into said first aqueous slurry at a predetermined volume and velocity to form a commingled aqueous slurry with said second aqueous slurry being introduced into said headbox with said velocity sufficient to allow said second aqueous slurry to penetrate into said first low stream a distance equal to at least about four times the diameter of said orifice;

d) passing said commingled aqueous slurry out of said headbox; and e) draining water from said commingled aqueous slurry to form a fibrous mat, said fibrous mat having increased strength adjacent to an edge located downstream from a point where said second aqueous slurry was introduced.

9. The method of claim 8 further including introducing a third aqueous slurry having a third flow rate into said other lateral side of said headbox.

10. The method of claim 9 further including introducing said second aqueous slurry at a different fiber consistency than said third aqueous slurry.

11. The method of claim 9 further including introducing said second aqueous slurry at a different flow rate than said third aqueous slurry.

12. The method of claim 8 wherein said second aqueous slurry is introduced into said side of said headbox at an angle of about 90 degrees to said direction of flow of said first aqueous slurry.

13. The method of claim 8 wherein said orifice has a diameter which is less than about 50% of said height of said headbox at said first position.

14. The method of claim 8 wherein said first aqueous slurry is introduced into said headbox at a higher fiber consistency than said second aqueous slurry.

15. A method for improving the edge strength of a thin fibrous mat comprising the steps of:

a) introducing a first aqueous slurry having a predetermined fiber consistency to an inlet of a two layered headbox and conveying said first aqueous slurry through said headbox to an outlet, said headbox having a top, a bottom, a pair of lateral sides, a back with an inlet formed therein and a front with an outlet formed therein, said lateral sides having an interior surface, said headbox having a partition formed therein which is positioned between said top and said bottom and functions to separate flow through said headbox into two channels, each of said two channels having a length and a height with said height decreasing along said length from said back to said front of said headbox, and said first aqueous slurry forming a first flow stream through said headbox in a first flow direction;

b) introducing a second aqueous slurry having a predetermined fiber consistency through a round orifice formed in at least one of said pair of lateral sides, said fiber consistency of said second aqueous slurry being different from said fiber consistency of said first aqueous slurry, said orifice having a predetermined diameter which is less than about 60% of said height of said headbox and said orifice being flush with said interior surface of one of said pair of lateral sides, said orifice being formed at a first position along said length of at least one of said two channels, and said second aqueous slurry being introduced into said first aqueous slurry as a second flow stream at a second flow direction, said second flow direction being at an angle of from between about 45 degrees to about 135 degrees to said first flow direction;

c) blending said second aqueous slurry into said first aqueous slurry at a predetermined volume and velocity to form a commingled aqueous slurry with said second aqueous slurry being introduced into said headbox with said velocity sufficient to allow said second aqueous slurry to penetrate into said first low stream a distance equal to at least about twice the diameter of said orifice;

d) passing said commingled aqueous slurry out of said headbox; and e) draining water from said commingled aqueous slurry to form a thin fibrous mat, said thin fibrous mat having increased strength adjacent to an edge located downstream from a point where said second aqueous slurry was introduced.

16. The method of claim 15 furthering including introducing a third aqueous slurry through a side of said headbox which is opposite to said side from which said second aqueous slurry was introduced.

17. The method of claim 15 wherein said second aqueous slurry and a third aqueous slurry are introduced on the same lateral side of said headbox.

18. The method of claim 15 wherein said second aqueous slurry is introduced through a side of said headbox at an angle of from between about 95 degrees to about 135 degrees to the direction of flow of said first aqueous slurry.

19. The method of claim 15 wherein said second aqueous slurry is introduced through a side of said headbox at an angle of from between about 75 degrees to about 105 degrees to the direction of flow of said first aqueous slurry.

20. The method of claim 19 wherein said second aqueous slurry is introduced through a side of said headbox at an angle of about 90 degrees to the direction of flow of said first aqueous slurry.

21. The method of claim 15 wherein said orifice has a diameter which is less than about 50% of said height of said headbox at said first position.

22. A method for improving the edge strength of a thin fibrous mat comprising the steps of:

a) introducing a first aqueous slurry having a predetermined fiber consistency to an inlet of a two layered headbox and conveying said first aqueous slurry through said headbox to an outlet, said headbox having a top, a bottom, a pair of lateral sides, a back with an inlet formed therein and a front with an outlet formed therein, said lateral sides having an interior surface, said headbox having a partition formed therein which is positioned between said top and said bottom and functions to separate flow through said headbox into two channels, each of said two channels having a length and a height with said height decreasing along said length from said back to said front of said headbox, and said first aqueous slurry forming a first flow stream through said headbox in a first flow direction;

b) introducing a second aqueous slurry having a predetermined fiber consistency through a round orifice formed in at least one of said pair of lateral sides, said fiber consistency of said second aqueous slurry being different from said fiber consistency of said first aqueous slurry, said orifice having a predetermined diameter which is less than about 60% of said height of said headbox and said orifice being flush with said interior surface of one of said pair of lateral sides, said orifice being formed at a first position along said length of at least one of said two channels, and said second aqueous slurry being introduced into said first aqueous slurry as a second flow stream at a second flow direction, said second flow direction being at an angle of from between about 45 degrees to about 135 degrees to said first flow direction;

c) blending said second aqueous slurry into said first aqueous slurry at a predetermined volume and velocity to form a commingled aqueous slurry with said second aqueous slurry being introduced into said headbox with said velocity sufficient to allow said second aqueous slurry to penetrate into said first low stream a distance equal to at least about four times the diameter of said orifice;

d) passing said commingled aqueous slurry out of said headbox; and e) draining water from said commingled aqueous slurry to form a thin fibrous mat, said thin fibrous mat having increased strength adjacent to an edge located downstream from a point where said second aqueous slurry was introduced.

23. The method of claim 22 furthering including introducing a third aqueous slurry through a side of said headbox which is opposite to said side from which said second aqueous slurry was introduced.

24. The method of claim 22 wherein said second aqueous slurry and a third aqueous slurry are introduced on the same lateral side of said headbox.

25. The method of claim 22 wherein said second aqueous slurry is introduced through a side of said headbox at an angle of from between about 95 degrees to about 135 degrees to the direction of flow of said first aqueous slurry.

26. The method of claim 22 wherein said second aqueous slurry is introduced through a side of said headbox at an angle of from between about 75 degrees to about 105 degrees to the direction of flow of said first aqueous slurry.

27. The method of claim 26 wherein said second aqueous slurry is introduced through a side of said headbox at an angle of about 90 degrees to the direction of flow of said first aqueous slurry.

28. The method of claim 22 wherein said orifice has a diameter which is less than about 50% of said height of said headbox at said first position.

29. A method for improving the edge strength of a thin fibrous mat comprising the steps of:

a) introducing a first aqueous slurry having a predetermined fiber consistency to an inlet of a multilayered headbox and conveying said first aqueous slurry through said headbox to an outlet, said headbox having a top, a bottom, a pair of lateral sides, a back with an inlet formed therein and a front with an outlet formed therein, said lateral sides having an interior surface, said headbox having at least two partitions formed therein which are positioned between said top and said bottom and which function to separate flow through said headbox into at least three channels, each of said channels having a length and a height with said height decreasing along said length from said back to said front of said headbox, and said first aqueous slurry forming a first flow stream having a first flow direction;

b) introducing a second aqueous slurry having a predetermined fiber consistency through a round orifice formed in at least one of said pair of lateral sides, said fiber consistency of said second aqueous slurry being different from said fiber consistency of said first aqueous slurry, said orifice having a predetermined diameter which is less than about 60% of said height of said headbox and said orifice being flush with said interior surface of one of said pair of lateral sides, said orifice being formed at a first position along said length of at least one of said two channels, and said second aqueous slurry being introduced into said first aqueous slurry as a second flow stream at a second flow direction, said second flow direction being at an angle of from between about 45 degrees to about 135 degrees to said first flow direction;

c) blending said second aqueous slurry into said first aqueous slurry at a predetermined volume and velocity to form a commingled aqueous slurry with said second aqueous slurry being introduced into said headbox with said velocity sufficient to allow said second aqueous slurry to penetrate into said first low stream a distance equal to at least about twice the diameter of said orifice;

d) passing said commingled aqueous slurry out of said headbox; and e) drying said commingled aqueous slurry to form a thin fibrous mat, said thin fibrous mat having increased strength adjacent to an edge located downstream from a point where said second aqueous slurry was introduced.

30. The method of claim 29 wherein said orifice has a diameter of less than about 50% of said height of said respective channel at said first position.

31. A method for improving the edge strength of a thin fibrous mat comprising the steps of:

a) introducing a first aqueous slurry having a predetermined fiber consistency to an inlet of a multilayered headbox and conveying said first aqueous slurry through said headbox to an outlet, said headbox having a top, a bottom, a pair of lateral sides, a back with an inlet formed therein and a front with an outlet formed therein, said lateral sides having an interior surface, said headbox having at least two partitions formed therein which are positioned between said top and said bottom and which function to separate flow through said headbox into at least three channels, each of said channels having a length and a height with said height decreasing along said length from said back to said front of said headbox, and said first aqueous slurry forming a first flow stream having a first flow direction;

b) introducing a second aqueous slurry having a predetermined fiber consistency through a round orifice formed in at least one of said pair of lateral sides, said fiber consistency of said second aqueous slurry being different from said fiber consistency of said first aqueous slurry, said orifice having a predetermined diameter which is less than about 60% of said height of said headbox and said orifice being flush with said interior surface of one of said pair of lateral sides, said orifice being formed at a first position along said length of at least one of said two channels, and said second aqueous slurry being introduced into said first aqueous slurry as a second flow stream at a second flow direction, said second flow direction being at an angle of from between about 45 degrees to about 135 degrees to said first flow direction;

c) blending said second aqueous slurry into said first aqueous slurry at a predetermined volume and velocity to form a commingled aqueous slurry with said second aqueous slurry being introduced into said headbox with said velocity sufficient to allow said second aqueous slurry to penetrate into said first low stream a distance equal to at least about four times the diameter of said orifice;

d) passing said commingled aqueous slurry out of said headbox; and e) drying said commingled aqueous slurry to form a thin fibrous mat, said thin fibrous mat having increased strength adjacent to an edge located downstream from a point where said second aqueous slurry was introduced.

32. The method of claim 31 wherein said orifice has a diameter of less than about 50% of said height of said respective channel at said first position.

* * * * *